US006550092B1

(12) United States Patent
Brown et al.

(10) Patent No.: US 6,550,092 B1
(45) Date of Patent: Apr. 22, 2003

(54) CLEANING SHEET WITH PARTICLE RETAINING CAVITIES

(75) Inventors: Colin W. Brown, Egham (GB); Edward Francis, Racine County, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/559,868

(22) Filed: Apr. 26, 2000

(51) Int. Cl.[7] ..... A47L 13/46; B32B 3/10

(52) U.S. Cl. ..... 15/104.002; 15/209.1; 15/231; 428/138

(58) Field of Search ..... 15/208, 209.1, 15/231, 228, 227, 104.002; 428/138, 139

(56) References Cited

U.S. PATENT DOCUMENTS

| | | | | |
|---|---|---|---|---|
| 198,816 | A | * | 1/1878 | Robinson |
| 2,453,441 | A | * | 11/1948 | Fair |
| 3,099,855 | A | * | 8/1963 | Nash |
| 3,485,708 | A | | 12/1969 | Ballou et al. |
| 3,494,821 | A | | 2/1970 | Evans |
| 3,616,157 | A | | 10/1971 | Smith |
| 3,877,103 | A | * | 4/1975 | Nash |
| 3,900,642 | A | * | 8/1975 | Michel |
| 3,965,518 | A | | 6/1976 | Muoio |
| 3,965,519 | A | | 6/1976 | Hermann |
| 4,144,370 | A | | 3/1979 | Boulton |
| 4,172,172 | A | | 10/1979 | Suzuki et al. |
| 4,276,338 | A | | 6/1981 | Ludwa et al. |
| 4,525,411 | A | * | 6/1985 | Schmidt |
| 4,603,069 | A | | 7/1986 | Haq et al. |
| 4,612,237 | A | | 9/1986 | Frankenburg |
| 4,644,592 | A | * | 2/1987 | Small |
| 4,906,513 | A | | 3/1990 | Kebbell et al. |
| 4,951,341 | A | * | 8/1990 | Shears |
| 4,993,099 | A | | 2/1991 | Emura et al. |
| 5,026,587 | A | * | 6/1991 | Austin et al. |
| 5,063,101 | A | * | 11/1991 | Grynaeus et al. |
| 5,280,664 | A | * | 1/1994 | Lin |
| 5,310,590 | A | | 5/1994 | Tochacek et al. |
| 5,510,175 | A | * | 4/1996 | Shizawa |
| 5,525,397 | A | | 6/1996 | Shizuno et al. |
| 5,614,284 | A | * | 3/1997 | Kranzler et al. |
| 5,725,927 | A | | 3/1998 | Zilg et al. |
| 5,858,504 | A | * | 1/1999 | Fitting |
| 6,132,841 | A | * | 10/2000 | Guthrie |
| 6,270,875 | B1 | * | 8/2001 | Nissing |
| 6,332,234 | B1 | * | 12/2001 | Graham et al. |

FOREIGN PATENT DOCUMENTS

| | | |
|---|---|---|
| DE | 35 46 101 A | 6/1987 |
| DE | 811030 | 9/1997 |
| EP | 0 156 160 A | 10/1985 |
| EP | 0848 927 A1 | 12/1997 |

(List continued on next page.)

OTHER PUBLICATIONS

Patent Abstracts of Japan, vol. 1998, No. 01, Jan. 30, 1998 & JP 09 224895 A (Uni Charm Corp_, Sep. 2, 1997 abstract.
Patent Abstracts of Japan, Publication No. 11276401/Publication Date Dec. 10, 1999/Fukuyoo Ibaraki:KK/ Throwaway Laminated Sheet For Cleaning.

*Primary Examiner*—Terrence R. Till

(57) ABSTRACT

A cleaning sheet is provided. The cleaning sheet includes a fabric layer with a plurality of cavities in at least one major surface. In one embodiment, fabric layer surface secured to a flexible backing layer so as to define an outer fabric surface with a plurality of cavities therein. The cavities can include a tacky bottom surface capable of enhancing the retention of dust and other particles. Cleaning implements and methods of cleaning surfaces using the cleaning sheet are also described.

18 Claims, 4 Drawing Sheets

FOREIGN PATENT DOCUMENTS

| | | | |
|---|---|---|---|
| EP | 0 865 755 A1 | | 9/1998 |
| EP | 0 872 206 A1 | | 10/1998 |
| EP | 0 945 251 A1 | | 9/1999 |
| FR | 2679115 | | 7/1991 |
| GB | 2 061 709 | | 10/1979 |
| GB | 2 289 405 A | | 5/1995 |
| JP | 63-48981 | | 10/1988 |
| JP | 5-25763 | | 2/1993 |
| JP | 9-220191 | * | 8/1997 |
| WO | WO 98/52458 | | 11/1998 |

* cited by examiner

CLEANING SHEET WITH PARTICLE RETAINING CAVITIES

BACKGROUND OF THE ART

Dust cloths for removing dust from a surface to be cleaned, such as a table, are generally known. Such known dust cloths may be made of woven or nonwoven fabrics and are often sprayed or coated with a wet, oily substance for retaining the dust. However, such known dust cloths tend to leave an oily film on the surface after use.

Other dust cloths utilize composites of fibers bonded together via adhesive, melt bonding, entanglement or other forces. To provide durable cloths, the staple fibers can be combined with some type of reinforcement, such as a continuous filament or network structure. Other cloths have attained the desired durability by employing fibers which are strongly bonded together, e.g., via adhesive bonding or melt bonding. While having good durability, such cloths may be less effective in their ability to pick up and retain particulates like dust and dirt.

Other known dust cloths include nonwoven entangled fibers having spaces between the entangled fibers for retaining the dust. The entangled fibers may be supported by a network grid or scrim structure, which can provide additional strength to such cloths. Cloths of this type can become saturated with the dust during use (i.e., dust buildup) and/or may not be completely effective at picking up denser particles, large particles or other debris.

Accordingly, it would be advantageous to provide cleaning sheets that can pick-up and retain debris. Such a cleaning sheet would preferably be capable of retaining relatively large and/or denser particles of debris while at the same time being very effective for picking up and retaining fine dust particles.

SUMMARY OF THE INVENTION

The present invention relates generally to cleaning sheets for use in cleaning surfaces, e.g., in the home or work environment. More particularly, the invention relates to a cleaning sheet for collecting and retaining dust, larger particles and/or other debris. The cleaning sheet includes a surface covered with a fabric material capable of picking up and retaining particulate matter and other debris, such as hair and lint. The outer surface of the fabric material includes a plurality of cavities therein. The cavities are typically larger relative to the particulate matter the cleaning sheets are designed to retain, e.g., commonly having a cross-sectional area of at least 3–4 $mm^2$. The fabric material may optionally be treated with and/or incorporate therein a dust adhesion agent to enhance its effectiveness.

The cleaning sheet can include a fabric layer secured to a flexible backing layer so as to define an outer fabric surface with a plurality of cavities therein. The cavities commonly include a tacky surface. The cleaning sheet may include adhesive disposed between the fabric layer and the flexible backing layer. In such an embodiment, the fabric layer can have a plurality of apertures therethrough which expose at least a portion of the adhesive thereby forming cavities which have a tacky bottom surface. The present cleaning sheets generally have a breaking strength of at least 500 g/30 mm and an elongation at a load of 500 g/30 mm of no more than about 25%.

In another embodiment, the cleaning sheet has a first surface including a nonwoven fiber aggregate layer. A flexible backing layer is secured to the nonwoven fiber aggregate layer. The first surface has a plurality of cavities therein, which include a tacky surface capable of retaining particles, such as dust and dirt. The nonwoven fiber aggregate layer may be secured to the flexible backing layer by an intervening adhesive layer, e.g., a layer of pressure sensitive adhesive. A suitable nonwoven fiber aggregate layer is formed from a loosely entangled fibrous web which has a plurality of apertures therethrough. Such a fibrous web typically has a basis weight of 30 to 100 $g/m^2$ and a CD initial modulus ("entanglement coefficient") of no more than 800 m.

As used herein, the term "entanglement coefficient" refers to the initial gradient of the stress-strain curve measured with respect to the direction perpendicular to the fiber orientation in the fiber aggregate (cross machine direction). The entanglement coefficient is also referred to herein as the "CD initial modulus." Suitable nonwoven fiber aggregates for use in forming the present cleaning sheets have an entanglement coefficient of 20 to 500 m (as measured after any reinforcing filaments or network has been removed from the nonwoven fibrous web) and, more typically, no more than about 250 m.

Cleaning sheets according to one embodiment can be produced by coating an adhesive layer onto at least one surface of a flexible backing layer. A fabric layer, such as a nonwoven fiber aggregate layer having a plurality of apertures therethrough, can then be secured onto the coating of the adhesive. Alternatively, a composite material having a surface covered with a fabric layer with a plurality of cavities therein can have adhesive selectively applied to a surface within the cavities, e.g., by spraying a solution or dispersion of a pressure sensitive adhesive onto the bottom surface of the cavities. The fabric layer can be secured to a flexible backing layer by any of a number of conventional methods, e.g., via point melt bonding, adhesive bonding or stitching.

The entanglement coefficient (also referred to herein as "CD initial modulus") as used herein is a measure representing the degree of entanglement of fibers in the fiber aggregate. The entanglement coefficient is expressed by the initial gradient of the stress-strain curve measured with respect to the direction perpendicular to the fiber orientation in the nonwoven fiber aggregate, i.e., in the cross machine direction ("cross direction" or "CD"). A smaller value of the entanglement coefficient represents a smaller degree of entanglement of the fibers. The term "stress" as used herein means a value which is obtained by dividing the tensile load value by the chucking width (i.e. the width of the test strip during the measurement of the tensile strength) and the basis weight of the nonwoven fiber aggregate. The term "strain" as used herein is a measure of the elongation of the cleaning sheet material.

The term "breaking strength" as used herein refers to the value of a load (i.e. the first peak value during the measurement of the tensile strength) at which the cleaning sheet begins to break when a tensile load is applied to the cleaning sheet.

As used herein, the term "elongation" refers to the relative increase in length (in percent) of a 30 mm strip of cleaning sheet material when a tensile load of 500 g is applied to the strip. The strip is elongated at a rate of 30 mm/min in the direction perpendicular to the fiber orientation (i.e, in the cross machine direction). As used herein the term "nonwoven fabric or web" means a web having a structure of individual fibers or threads which are interlaid, but not in a regular or identifiable manner as in a knitted fabric. The term also includes individual filaments and strands, yarns or tows as well as foams and films that have been fibrillated, apertured, or otherwise treated to impart fabric-like properties. Nonwoven fabrics or webs have been formed from many processes such as for example, meltblowing processes, spunbonding processes, and bonded carded web processes. The basis weight of nonwoven fabrics is usually expressed in ounces of material per square yard ("osy") or grams per square meter ("gsm"). Fiber diameters useful are usually expressed in microns. Basis weights can be converted from osy to gsm simply by multiplying the value in osy by 33.91.

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. For example, the diameter of a polypropylene fiber given as 15 microns may be converted to denier by squaring the diameter, multiplying the result by 0.89 g/cc and multiplying by 0.00707. Thus, a 15 micron polypropylene fiber has a denier of about 1.42 ($15^2 \times 0.89 \times 0.00707 = 1.415$). A lower denier indicates a finer fiber and a higher denier indicates a thicker or heavier fiber. Outside the United States the unit of measurement is more commonly the "tex", which is defined as the grams per kilometer of fiber. Tex may be calculated as denier/9.

As used herein, the term "average cross-sectional dimension" refers to the average dimension of a cavity in an outer fabric surface of the present cleaning sheet. The "average cross-sectional dimension" ("ACSD") is equal to one half of the sum of the length of the longest cross sectional axis ("$L^l$") of the cavity plus the cross sectional axis perpendicular to the longest cross sectional axis ("$L^s$"), i.e., $$ACSD=(L^l+L^s)/2.$$

The term "cross-sectional area" is used herein to refer to the area of a cavity in the outer plane of the fabric surface (i.e., in the cleaning surface). Most cavities will not have sides which are perpendicular to this plane and, thus, the cross-sectional area of a cavity is often larger than the area encompassed by the bottom of the cavity. Where the term "cross-sectional area" is used in reference to a perforation (hole) through the fabric layer, it likewise refers to the area of the perforation at the outer plane of the fabric surface.

It is important to note that the terms "surface" and "surface to be cleaned" as used in this disclosure are broad terms and are not intended as terms of limitation. The term surface includes substantially hard or rigid surfaces (e.g., articles of furniture, tables, shelving, floors, ceilings, hard furnishings, household appliances, and the like), as well as relatively softer or semi-rigid surfaces (e.g., rugs, carpets, soft furnishings, linens, clothing, and the like).

It is also important to note that the term "debris" is a broad term and is not intended as a term of limitation. In addition to dust and other fine particulate matter, the term debris includes relatively large-sized particulate material, e.g., having an average diameter greater than about 1 mm, such as large-sized dirt, soil, lint, and waste pieces of fibers and hair, which may not be collected with conventional dust rags, as well as dust and other fine dirt particles.

Throughout this application, the text refers to various embodiments of the cleaning sheet. The various embodiments described are meant to provide a variety illustrative examples and should not be construed as descriptions of alternative species. Rather it should be noted that the descriptions of various embodiments provided herein may be of overlapping scope. The embodiments discussed herein are merely illustrative and are not meant to limit the scope of the present invention.

DETAILED DESCRIPTION

The present cleaning sheets are suitable for cleaning and removing particulate material (e.g., dust, soil and other airborne matter) and other debris, such as lint and hair, from a variety of surfaces. The sheets are particularly suitable for cleaning hard, rigid surfaces but may also be utilized on relatively soft surfaces such as carpets, rugs, upholstery and other soft articles. The dimensions of the cleaning sheet are not believed to be critical to the present invention. The cleaning sheets can have a wide variety of shapes and sizes which one skilled in the art will understand can be varied as desired to accommodate different types, shapes and/or sizes of specific surfaces to be cleaned.

The present cleaning sheets can include a fabric layer secured to a flexible backing layer so as to define an outer fabric surface with a plurality of cavities. While it is not required, the cavities generally include a tacky surface therein. The tacky surface typically includes pressure sensitive adhesive. In one embodiment of the invention, the cleaning sheet includes an adhesive layer disposed between a perforated fabric layer and the flexible backing layer. In such an embodiment, perforations in the fabric layer expose a portion of the adhesive layer, thereby forming an outer fabric surface with a plurality of tacky bottomed cavities. The other portions of adhesive layer can serve to secure the backing layer to the fabric layer.

The cleaning sheet may be formed from a perforated fabric layer secured to a flexible backing layer in another manner, e.g., via stitching or melt bonding. Alternatively, the cleaning sheet may consist solely of a thicker fabric layer with a plurality cavities in at least one major surface. In either instance, an adhesive (such as a PSA) can be sprayed or coated onto the bottom surfaces within the cavities to form tacky surfaces therein.

Figure 1:
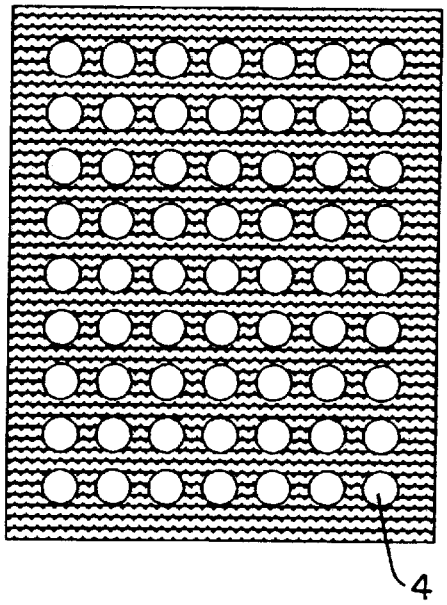
FIG. 1 shows a plan view of one example of a nonwoven fiber aggregate layer which can be used to form a cleaning sheet.
Figure 2:
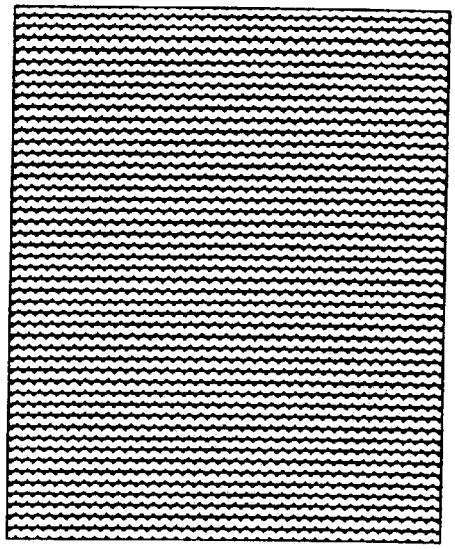
FIG. 2 shows a plan view of one example of a flexible backing layer which can be used to form a cleaning sheet.

The cavities 4 in the outer fabric surface can trap and retain a significant amount of debris. For example, debris can be embedded against a wall of the cavity in addition to by adhesive on a "tacky" surface within the cavity. Cavities 4 are shown in FIG. 1 as having a circular shape, but may be any shape or combination of shapes such as rounded, jagged, irregular, etc. For example, the cavities in the outer surface of the fabric layer may be rectangular, star, oval, or irregular shaped. The cavities may be disposed in a regular pattern, as depicted in FIG. 1 or may be randomly arranged in the outer surface of the fabric layer.

The cavities are generally of a sufficient size to allow significantly sized debris (e.g., up to 2–4 mm) to pass through and come into contact with the adhesive coated surface. After passing through the holes, the debris can become entrapped in part by the fabric of side of the holes (i.e., cavities) of the outer fabric layer in addition to interacting with the adhesive in the cavity. According to a suitable embodiment, the average cross-sectional dimension of the cavities range from about 1.0 to 10.0 mm, more suitably in the range of about 2.0 to 5.0 mm.

The size and depth of the cavities should preferably be large enough to prevent the adhesive from making substantial contact with the surface to be cleaned while at the same time creating a sufficient sized "pocket" in the cleaning surface of the fabric layer to keep entrained debris from scratching the surface being cleaned. The cavities are preferably not so deep, however, that it is difficult for debris to be brought into contact with the adhesive-coated surface within the cavity. The cavities typically have an average depth of about 0.1 to 5 mm, more suitably 1 to 3 mm.

The size of the cavities can also be characterized in terms of their average cross-sectional area. Each of cavities in the outer surface ("cleaning surface") of the fabric layer has a cross sectional area. The average cross sectional area of cavities in the fabric layer is generally at least about 1.0 $mm^2$, more suitably in the range of about 2.0 to 100 $mm^2$. Typical cleaning sheets have a plurality of cavities with an average cross sectional area in the range of about 5.0 to about 25.0 $mm^2$. The cross sectional area of all the cavities relative to the total surface area of the exterior surface of the fabric layer is generally at least about 5%. The total cross sectional area of the cavities is commonly no more than about 25% of the total surface area. Examples of particularly suitable cleaning sheets include those where the cross sectional area of all the cavities relative to the total surface area is about 10% to 20%, although the cavities may make up a larger percentage of the total surface area of a cleaning sheet, e.g., up to about 40% of the total area. The number, depth and average cross sectional area of the cavities can be selected to allow maximum amount of debris to be collected in the cavities, while maintaining a separation between the adhesive and the surface to be cleaned.

As mentioned above, the cleaning sheet is thick enough to permit cavities of sufficient depth to entrap particles without damaging the surface to be cleaned. The cavities should also be of sufficient depth to prevent adhesive from being deposited from the tacky surfaces within the cavities onto the surface being cleaned. Typically, the cleaning sheet has an overall thickness of at least about 1 mm and, suitable cleaning sheets often have thicknesses of about 1.5 mm to 3 mm. In order to accommodate cavities of sufficient depth, the fabric layer of the cleaning sheets is commonly at least about 0.5 mm thick and preferably, about 1 mm to 2 mm thick. As noted elsewhere herein, some embodiments of the cleaning sheets may not include a flexible backing layer. Such sheets may be formed from a slightly thicker fabric layer (e.g., about 3 mm to 5 mm) which includes cavities of up to about 3–4 mm in depth in at least one of its major surfaces.

In yet another embodiment, the cleaning sheet may be formed from a single layer of fabric material. In this instance, the fabric layer in generally somewhat thicker. The flexible backing layer which is present in other embodiments of the cleaning sheet typically serves to provide strength and dimensional stability to the sheet. These functions may also be provided by a suitably designed fabric layer. Such sheets are suitably thick enough to include a plurality of supporting filaments and/or a supporting network sheet within the layer.

According to a particularly suitable embodiment, the cleaning sheet includes an outer nonwoven fabric layer formed from microfibers. The nonwoven fabric layer is typically a loose aggregate of the microfibers. The denier of the fibers in the fiber aggregate, the length, the cross-sectional shape and the strength of the fibers used in the nonwoven fiber aggregate are typically also determined with an eye toward processability and cost, among other factors. The microfibers commonly have a denier of about 0.1 to 6 and, more typically, about 0.5 to 3. One example of a suitable nonwoven fabric for use as the outer surface layer of a cleaning sheet is nonwoven fiber aggregate layer formed from a mixture of relatively thicker microfibers having a denier of 1 to 5 (preferably 1 to 3) and finer fibers having a denier of no more than about 0.9 and generally at least about 0.2 (preferably about 0.5 to 0.9). Such nonwoven aggregates for use in producing the present cleaning sheets suitably have such thicker and finer fibers present in a weight ratio of about 50:50 to about 20:80.

Figure 3:
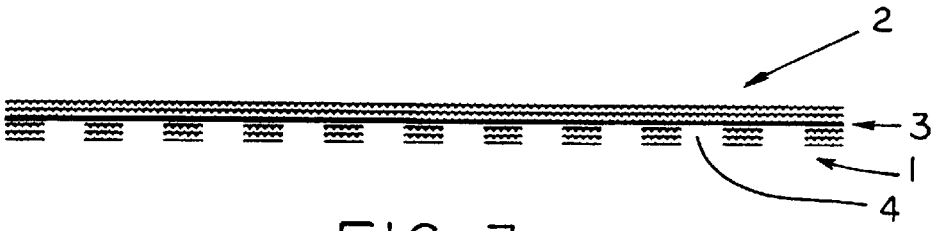
FIG. 3 shows a cross-sectional view of one embodiment of a cleaning sheet.

FIG. 3 shows a cross-sectional view of one embodiment of the present cleaning sheet. The nonwoven aggregate layer of the cleaning sheet is shown made of an entangled network of nonwoven fibers 1 having a plurality of holes 4 ("perforations") therethrough. Pores which can also trap debris are formed by the spaces between the entangled fibers in the nonwoven layer (i.e., debris can be retained between the fibers that form the nonwoven aggregate layer). Larger particles and other debris can be entrapped and retained by the adhesive layer 3 which is exposed by the perforations 4 in the nonwoven fabric layer 1. A flexible backing layer 2 is secured to the nonwoven layer 1 by the adhesive layer 3.

Figure 4:
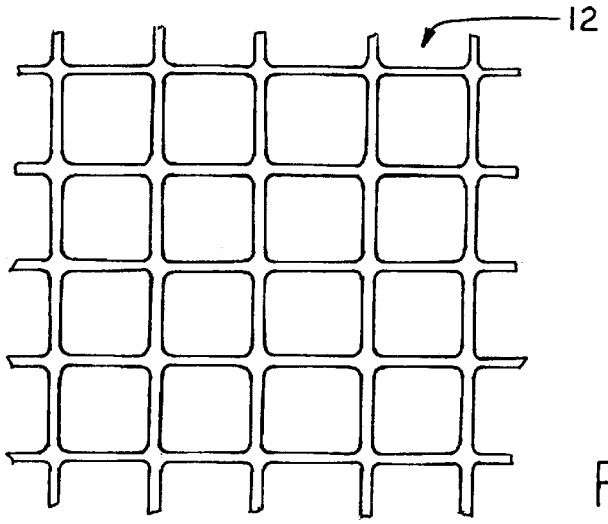
FIG. 4 shows a plan view of a lattice-like network sheet which can be used to reinforce a nonwoven fiber aggregate layer employed to produce one embodiment of the present cleaning sheet.

In another embodiment, a web or lattice (shown as a scrim) may be embedded in and support the fibers of the nonwoven layer. The scrim is commonly integrally embedded within the fibers of the nonwoven aggregate layer to form a unitary structure for the layer. The scrim typically includes a net having horizontal members attached to vertical members arranged in a "network" configuration. Spaces (shown as holes) are formed between vertical members and horizontal members to give scrim a mesh or lattice-like structure. According to various embodiments, the horizontal and vertical members of the scrim may be connected together in a variety of ways such as woven, spot welded, cinched, tied, etc. One example of a such a lattice which may be used to provide support for the nonwoven layer during processing and use is shown in FIG. 4.

Figure 5:
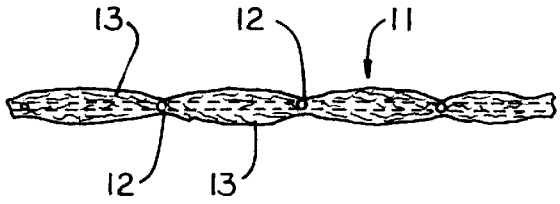
FIG. 5 shows a cross-sectional view of one embodiment of a nonwoven fiber aggregate layer which can be employed to produce a cleaning sheet.

To attach the fibers to a scrim, thereby forming nonwoven fiber aggregate layer as a unitary structure, the fibers may be overlaid on each side of the scrim. A low pressure water jet can then be applied to entangle the fibers of the nonwoven fiber aggregate to each other and to the scrim (i.e., hydroentanglement) to form a relatively lose entanglement of nonwoven fibers. Hydroentanglement of the fibers may be further increased during removal (e.g., drying) of the water from the water jet. The fibers may also be attached to the network sheet by other methods known to those of skill in the art (e.g., air laid, adhesive, woven). The fibers are typically entangled onto the web to form a unitary body, which can assist in preventing "shedding" of the fibers from the web during cleaning. FIG. 5 shows one example of a scrim-supported nonwoven layer 11 which can be utilized as the fabric layer in forming the present cleaning sheets. The cross-sectional view of the scrim-supported nonwoven fiber aggregate 11 shows the filaments 12 embedded within an hydroentangled nonwoven fiber web 13. Holes are typically cut out of the nonwoven material from spaces between the filaments or grid of the network sheet.

As fabric layer used to form the present cleaning sheets, a nonwoven aggregate layer having fibers with a large degree freedom and sufficient strength is advantageous for effectively collecting and retaining dust and larger particulates within the cleaning sheet. In general, a nonwoven fabric formed by the entanglement of fibers involves a higher degree of freedom of the constituent fibers than in a nonwoven fabric formed only by fusion or adhesion of fibers. The nonwoven fabric formed by the entanglement of fibers can exhibit better dust collecting performance through the entanglement between dust and the fibers of the nonwoven fabric. The degree of the entanglement of fibers can have a large effect on the retention of dust. That is, if the entanglement becomes too strong, the freedom of fibers to move will be lower and the retention of dust is generally decreased. In contrast, if the entanglement of the fibers is very weak, the strength of the nonwoven fabric can be markedly lower, and the processability of the nonwoven fabric may be problematic due to its lack of strength. Also, shedding of fibers from the nonwoven fabric is more likely to occur from a nonwoven aggregate with a very low degree of entanglement.

A suitable nonwoven aggregate for use in producing the present cleaning sheets can be formed by hydroentangling a fiber web (with or without embedded supporting filaments or a network sheet) under relatively low pressure. For example, the fibers in a carded polyester nonwoven web can be sufficiently entangled with a network sheet by processing the nonwoven fiber webs with water jetted at high speed under 25–50 kg/cm$^3$ of pressure. The water can be jetted from orifices positioned above the web as it passes over substantially smooth non-porous supporting drum or belt. The orifices-typically have a diameter ranging between 0.05 and 0.2 mm and can be suitably arranged in rows beneath a water supply pipe at intervals of 2 meters or less.

The supporting filaments and/or network sheet may be formed from a variety of materials, such as polypropylene, nylon, polyester, etc. Exemplary webs (i.e., scrims) are described in U.S. Pat. No. 5,525,397, the disclosure of which is herein incorporated by reference. Suitable materials which may be used to form the network sheet may be selected from, for example, polyolefins such as polyethylene, polypropylene and polybutene; olefin copolymers formed from monomers such as ethylene, propylene and butene; olefin-vinyl ester copolymers, such as ethylene-vinyl acetate copolymers; acrylonitrile polymers and copolymers; polyesters such as polyethylene terephthalate and polybutylene terephthalate; polyamides such as nylon 6 and nylon 66; acrylonitriles; vinyl polymers such as polyvinyl chloride; vinylidene polymers such as polyvinylidene chloride; modified polymers; and mixtures thereof.

The nonwoven aggregate layer used to form the present cleaning sheets typically has a relatively smooth surface apart from some gathering of the microfibers in the portions immediately adjacent to a supporting network (see, e.g., the cross-sectional view depicted in FIG. 5). This is, however, not a requirement as nonwoven sheets having a relatively "wavy" surface, i.e., having a plurality of peaks and valleys with dimensions smaller than those of the cavities in the surface, may be employed. Examples of such materials are described in U.S. Pat. No. 5,310,590, International Patent Application No. 98/52458 and Japanese Laid Open Patent Document No. 5-25763 (laid open on Feb. 2, 1993), the disclosure of which is herein incorporated by reference. One method of forming such wavy surfaced sheets is to hydroentangle one or more layers of nonwoven fibers with a thermally shrinkable supporting scrim. After hydroentangling a nonwoven web with the supporting scrim the resulting structure can be subjected to a heat treatment so that the structure is dried as the scrim is simultaneously shrunk. One example of a method of producing such a sheet is set forth in Example 2 herein.

Backing Material

The outer cleaning surface of fabric layer 1 is a generally smooth and compliant (e.g., flexible) generally planar sheet for cleaning delicate surfaces (e.g., wood, glass, plastic, etc.) or hard surfaces. Backing layer 2 may be more rigid and/or have a greater basis weight than fabric layer 1 to provide support and structure to the cleaning sheet. According to other alternative embodiments, a space or other intermediate layers may be positioned between the backing layer and the outer fabric layer.

A variety of materials are suitable for use as a backing layer in the present cleaning sheets so long as this layer has the desired degree of flexibility and is capable of providing sufficient support to the sheet as a whole. Examples of suitable materials for use as a backing layer include a wide variety of lightweight (e.g., having a basis weight of about 10 to 75 g/m$^2$), flexible materials capable of providing the sheet with sufficient strength to resist tearing or stretching during use. The backing layer is typically relatively thin, e.g., has a thickness of about 0.05 mm to about 0.5 mm, and can be relatively non-porous. Examples of suitable materials include spunbond and thermal bond nonwovens sheets formed from synthetic and/or natural polymers. Other backing materials which can be utilized to produce the present cleaning sheets include relatively non-porous, flexible layers formed from polyester, polyamide, polyolefin or mixtures thereof. The backing layer could also be made of hydroentangled nonwoven fibers so long as it meets the performance criteria necessary for the particular application. One specific example of a suitable backing layer is a spun bond polypropylene sheet with a basis weight of about 20 to 50 g/m$^2$.

Physical Parameters of the Cleaning Sheet

The cleaning sheet typically has a relatively low overall breaking strength in order to preserve a relative amount of flexibility. The term "breaking strength" as used in this disclosure means the value of a load (i.e., the first peak value during the measurement of the tensile strength) at which the cleaning sheet begins to break when a tensile load is applied to the cleaning sheet. The breaking strength of the sheet should, however, be high enough to prevent "shedding" or tearing of the cleaning sheet during use. The breaking strength of the cleaning sheet is typically at least about 500 g/30 cm and cleaning sheets with breaking strengths of 1,500 g/30 cm to 4,000 g/30 cm are quite suitable for use with the cleaning implements described herein.

The cleaning sheet typically includes an outer nonwoven fiber layer which has a relatively low basis weight as the outer fabric layer (i.e., the material on the cleaning surface of the sheet). According to a particularly suitable embodiment, the nonwoven layer has a basis weight in the range of about 20 to 150 g/m$^2$, preferably 30 to 75 g/m$^2$. A low basis weight can assist in providing a "stream-line" or compact look and feel to the cleaning sheet.

Where intended to be used with a cleaning utensil, mounting structure or the like, the cleaning sheet typically has a relatively low overall elongation to assist in resisting "bunching" or "puckering" of the cleaning sheet. The term "elongation" as used in this disclosure means the elongation percentage (%) of the cleaning sheet when a tensile load of 500.0 g/30.0 mm is applied. For example, when designed to be used in conjunction with a mop or similar cleaning implement where the cleaning sheet is fixedly mounted, the present cleaning sheets typically have an elongation of no more than about 25% and, preferably, no more than about 15%.

The basis weight of the nonwoven fiber aggregate generally falls within the range of 30 to 100 g/m$^2$ and, typically is no more than about 75 g/m$^2$. If the basis weight of the nonwoven fiber aggregate layer is less than about 30 g/m$^2$, dust may pass too easily through the nonwoven fiber aggregate during the cleaning operation and its dust collecting capacity may be limited. If the basis weight of the nonwoven fiber aggregate is too large, e.g., substantially greater than 150 g/m$^2$, the fibers in the aggregate and the network sheet generally may not be sufficiently entangled with each other to achieve a desirable degree of entanglement. In addition, the processability of the nonwoven aggregate can worsen, and shedding of the fibers from the cleaning sheet may occur more frequently. The denier of the fibers in the fiber aggregate, the length, the cross-sectional shape and the strength of the fibers used in the nonwoven fiber aggregate are generally determined with an eye toward processability and cost, in addition to factors relating to performance.

In cases where the entanglement coefficient of the fiber aggregate, which is expressed by the initial gradient of the stress-strain curve measured with respect to the direction perpendicular to the fiber orientation (i.e., "CD initial modulus"), is to be set at a value not greater than 800 m, as in the cleaning sheet in accordance with the present invention, it may be difficult for a sheet, which is constituted only of a fiber aggregate, to achieve the values of the breaking strength and the elongation described above. In order to set the entanglement coefficient at a value not larger than 800 m, a network sheet and the fiber aggregate can be entangled and combined with each other into a unitary body for use as the fabric layer in the cleaning sheets. By entangling the fiber aggregate with the network sheet into a unitary body, and the elongation of this layer is kept low and its processability can be enhanced. Shedding of the fibers from the cleaning sheet in accordance with the present invention can often be markedly prevented as compared with a conventional entangled sheet, which is constituted only of a fiber aggregate in approximately the same entanglement state as that in the fiber aggregate of the cleaning sheet in accordance with the present invention.

If the entanglement coefficient is too small, e.g., no more than about 10 to 20 m, the fibers will not be sufficiently entangled together. In addition, the entanglement between the fibers and the network sheet will likely be poor as well. As a result, shedding of the fibers may occur frequently. If the entanglement coefficient is too large, e.g., greater than about 700 to 800 m, a sufficient degree of freedom of the fibers cannot be obtained due to too strong entanglement. This can prevent the fibers from easily entangling with dust, hair and/or other debris, and the cleaning performance of the sheet may not be satisfactory.

The degree of the entanglement of the fibers depends on the entanglement energy applied to the fiber web during the entanglement process. For example, in the water needling process, the entanglement energy applied to the fiber web can be controlled from the view point of the type of fibers, the basis weight of the fiber web, the number and positioning of the water jet nozzles, the water pressure and the line speed among other factors.

In cases where the network sheet is a fiber net, such as shown in FIG. 4, the mesh, the fiber diameter, the distance between fibers (and consequently the size of the holes) and the configuration of the holes are generally determined from the view point of the local entanglement with the nonwoven fiber aggregate. Specifically, the diameter of the holes ("gaps") typically falls within the range of 5 mm to 30 mm. Stated otherwise, the distance between adjacent parallel rows of fibers commonly falls within the range of 5 mm to 30 mm, and more preferably falls within the range of 10 mm to 20 mm.

The fibers used to form the fiber aggregate are suitably made from any of a number of thermoplastic fibers such as polyesters (e.g., polyethylene terephthalate), polyamides and polyolefins; composite fibers thereof, divided fibers thereof, and ultra thin fibers thereof, such as produced by a melt blown process; semi-synthetic fibers such as acetate fibers; regenerated fibers such as rayon; and natural fibers such as cotton and blends of cotton and other fibers. The fibers typically have a denier of about 0.2 to 6, more preferably 0.5 to 3.

Adhesive

Versions of the present cleaning sheets which employ adhesive, typically include a suffient amount of adhesive to render a surface within the cavities tacky without having excess adhesive that could be transferred to a surface being cleaned. This means that the fibers in the adhesive-containing areas are generally coated with adhesive at or below the saturation point. The level of adhesive present should be sufficient to impart the treated fibers with the capability to demonstrate adhesion of larger particles brought into direct contact with the treated fibers. Suitable cleaning sheets often include about 0.1 to 5 wt. % and, more typically, about 0.5 to 1 wt. % adhesive (as a weight percentage of the total weight of the cleaning sheet).

A wide variety of coatable and/or sprayable adhesives can be used to produce the present cleaning sheets. Examples of classes of adhesives that are suitable for use in forming the present cleaning sheets include silicones, polyolefins, polyurethanes, polyesters, acrylics, rubber-resin and polyamides. Pressure sensitive adhesives ("PSAs") are particularly suitable for use in forming tacky surface(s) in the cavities in the present cleaning sheets. Suitable pressure sensitive adhesives include solvent-coatable, hot melt-coatable, radiation-curable (e.g., E-beam or UV curable) and water-based emulsion type adhesives that are well-known in the art.

The adhesive may be spread or sprayed onto the surface to be coated. Depending on the design of the cleaning sheet, the adhesive may be applied as a continuous layer, e.g., onto the flexible backing layer used to form the sheet, or applied in a discontinuous manner. For example, the adhesive may be sprayed into the bottoms of cavities in the outer fabric surface of the sheet. In another embodiment, cleaning sheets may be form by spreading or spraying discontinuous patches of an adhesive onto a flexible backing layer and laminating the adhesive-coated layer with a perforated fabric layer such that at least a portion of the adhesive coating is exposed through the perforations (holes) in the fabric layer. If only a portion of the adhesive is exposed, the remaining adhesive may serve to bond and hold the two layers together. Alternatively, the entirety of the adhesive-coated areas may be exposed by the holes in the fabric layer and the two layer may be held together by another technique, e.g., via stitching, melt bonding or other conventional methods known to those in the art.

As used herein, the term "pressure sensitive adhesive" ("PSA") refers to a category of adhesives which in dry (solvent free) form are aggressively and permanently tacky at room temperature. PSAs can generally firmly adhere to a variety of dissimilar surfaces without requiring more than finger or hand pressure to develop an adhesive bond. PSAs commonly have a sufficiently cohesive holding and elastic nature that, despite their aggressive tackiness, PSA-coated articles (e.g., films or layers) can be handled with the fingers and removed from smooth surfaces without leaving a residue of adhesive. PSAs are generally soft polymer matrices which may include an added tackifying resin. PSAs are generally used in applications where only one surface requires coating with the adhesive. An adhesive bond is developed by pressing a second surface (or individual particles of a second material, e.g., dust, dirt and/or other debris) against the PSA-coated surface.

Specific examples of suitable types of adhesives include acrylic-based adhesives, e.g., isooctyl acrylate/acrylic acid copolymers, styrene/acrylic polymers and tackified acrylate copolymers; tackified rubber-based adhesives, e.g., tackified styrene-isoprene-styrene block copolymers; tackified styrene-butadiene-styrene block copolymers; nitrile rubbers, e.g., acrylonitrile-butadiene; silicone-based adhesives, e.g., polysiloxanes; and polyurethanes. Acrylics are one particularly suitable class of adhesives for creating a tacky surface in the cavities of the present cleaning sheets. Wide variations in chemical composition exist for the acrylic adhesive class. In general, adhesives of this type are copolymers formed from monomer mixtures which include ant least one of acrylic acid, methacrylic acid, salts thereof and esters thereof. Examples of acrylic adhesives are disclosed in U.S. Pat. Nos. 4,223,067 and 4,629,663, the disclosures of which are herein incorporated by reference.

The acrylics are often formulated as water-based emulsions, e.g., 30–60 wt. % acrylic emulsified in water which may contain a small amount of surfactant. The water-based emulsion is sprayed or otherwise coated onto a surface (e.g., the flexible backing layer) and the water is evaporated, either at room temperature or elevated temperatures. In some instances, the adhesive may be cured, such as during drying with warm air and/or through the application of IR or UV irradiation. Examples of commercially available water-based acrylic adhesives which may be used to form the present cleaning sheets include 4224-NF acrylic polymer (available from 3M, St. Paul, Minn.), Jonbond® 712, Jonbond® 745 and Jonbond® 746 acrylic emulsion PSAs (available from S.C. Johnson Polymers, Racine Wis.).

Hot melt adhesives and, in particular, hot melt pressure sensitive adhesives are also quite suitable for use in producing the present cleaning sheets. Hot melt adhesives are thermoplastic materials which are applied to a surface in molten form (e.g., after heating to a temperature of about 275–350° F.) and then form a conventional adhesive upon cooling to a more viscous state (generally at room temperature). One example of a commercially available hot melt pressure sensitive adhesive which may be used to form the present cleaning sheets is Easymelt® 34-5640, a naphthenic hydrotreated distillate hot melt (available from National Starch and Chemical Company). Other examples of suitable hot melt PSAs include Uni-Flex® 34-1211 (available from National Starch and Chemical Company) and HL-2198-X and HM-1962 hot melt adhesives (available from H.B. Fuller Company, St. Paul, Minn.).

Dust Adhesion Agent

In accordance with the performance functions typically required for the present cleaning sheet, it may be advantageous to incorporate some form of dust adhesion agent in the fabric layer. Herein, agents which enhance the dust collecting capabilities of the cleaning sheet in some manner are referred to as "dust adhesion agents." For example, the fabric layer may be a nonwoven fiber aggregate layer which includes a lubricant and/or surface-active agent. The surface active agent may improve the surface physical properties of the fiber aggregate and enhance the cleaning sheet's ability to absorb dust.

The inclusion of lubricant can also impart gloss to a surface being cleaned with the sheet as well as enhancing the dust collecting efficiency of the cleaning sheet.

The dust adhesion agents are commonly added in an amount of 0.1 to 20 wt. % (add-on wt. % based on the weight of the fabric layer being treated). More typically, no more than about 10 wt. % (add-on basis) of the dust adhesion agent is added to the fabric layer. Particularly suitable embodiments of the present cleaning sheets include a fabric layer which has been treated with about 3 to about 10 wt. % (add-on basis) of the dust adhesion agent. As will be understood by those skilled in the art, the amount of dust adhesion agent utilized will depend on the specific type of fabric material being treated, the specific dust adhesion agent employed and the type of application the cleaning sheet is designed to be utilized for, among other factors.

Suitable lubricants for use as dust adhesion agents in the present cleaning sheets include mineral oils, synthetic oils, and silicone oils. Examples of mineral oils which may be employed include paraffin hydrocarbons, naphthenic hydrocarbons, and aromatic hydrocarbons. Suitable synthetic oils include alkylbenzene oils, polyolefin oils, polyglycol oils and the like. Suitable silicone oils include acrylic dimethyl polysiloxane, cyclic dimethyl polysiloxane, methylhydrogen polysiloxane, and various modified silicone oils.

The mineral oils, synthetic oils and silicone oils generally have a viscosity of 5 to 1000 cps, particularly 5 to 200 cps (at 25° C.). If the viscosity is lower than about 5 cps, the dust-adsorbing property can be decreased. If the viscosity is greater than about 1000 cps, the lubricant can sometimes fail to spread uniformly on the fibers. In addition, friction coefficient to the surface to be cleaned may increase, possibly causing damage of the surface to be cleaned. The mineral oils, synthetic oils and silicone oils commonly have a surface tension of 15 to 45 dyn/cm, particularly 20 to 35 cyn/cm (at 25° C.). If the surface tension is lower than 15 dyn/cm, the dust-adsorbing property of the treated fabric can become worse, and if it is higher than 45 dyn/cm, the lubricant sometimes fails to spread uniformly on the fibers constituting the nonwoven fabric.

As indicated above, the dust adhesion agents may include a surfactant. The surfactant component typically includes cationic and/or nonionic surfactant(s). Examples of suitable include cationic surfactants include mono(long-chain alkyl) trimethylammonium salts, di(long-chain alkyl)

dimethylammonium salts, and mono(long-chain alkyl) dimethylbenzylammonium salts, each having an alkyl or alkenyl group containing 10 to 22 carbon atoms. Examples of suitable include nonionic surfactants include polyethylene glycol ethers, e.g., polyoxyethylene (6 to 35 mol) primary or secondary long-chain ($C_8$–$C_{22}$) alkyl or alkenyl ethers, polyoxyethylene (6 to 35 mol) ($C_8$–$C_{18}$) alkyl phenyl ethers, polyoxyethylene polyoxypropylene block copolymers, and those of polyhydric alcohol type, e.g., glycerol fatty acid esters, sorbitan fatty acid esters, and alkyl glycosides. It is preferred that the surface active agent contains 5% by weight or less of water to enhance effective cleaning.

The dust adhesion agents typically include a minor amount of a surfactant together with a lubricant. Typically, the dust adhesion agents include at least about 70 wt. % and, preferably, at least about 80 wt. % of a lubricant made up of mineral oil, synthetic oil and/or silicone oil. One example of a suitable dust adhesion agent is made up of 90–95 wt. % of a mineral oil such as petrolatum or a related paraffinic hydrocarbon together with 5–10 wt. % of a nonionic surfactant, e.g., a polyoxyethylene alkyl ether such as a polyoxyethylene ($C_{12}$–$C_{14}$) alkyl ether having an average of 3–5 oxyethylene subunits.

The present cleaning sheets typically are capable of picking up and retaining at least about at least about 20 g/m$^2$ of dust. Stated otherwise, the cleaning sheet has a particle retention capacity of at least about 20 g/m$^2$. Preferably, the cleaning sheet has a particle retention capacity of at least about 25 g/m$^2$, more preferably at least about 40 g/m$^2$ and, most preferably, at least about 50 g/m$^2$.

Figure 8:
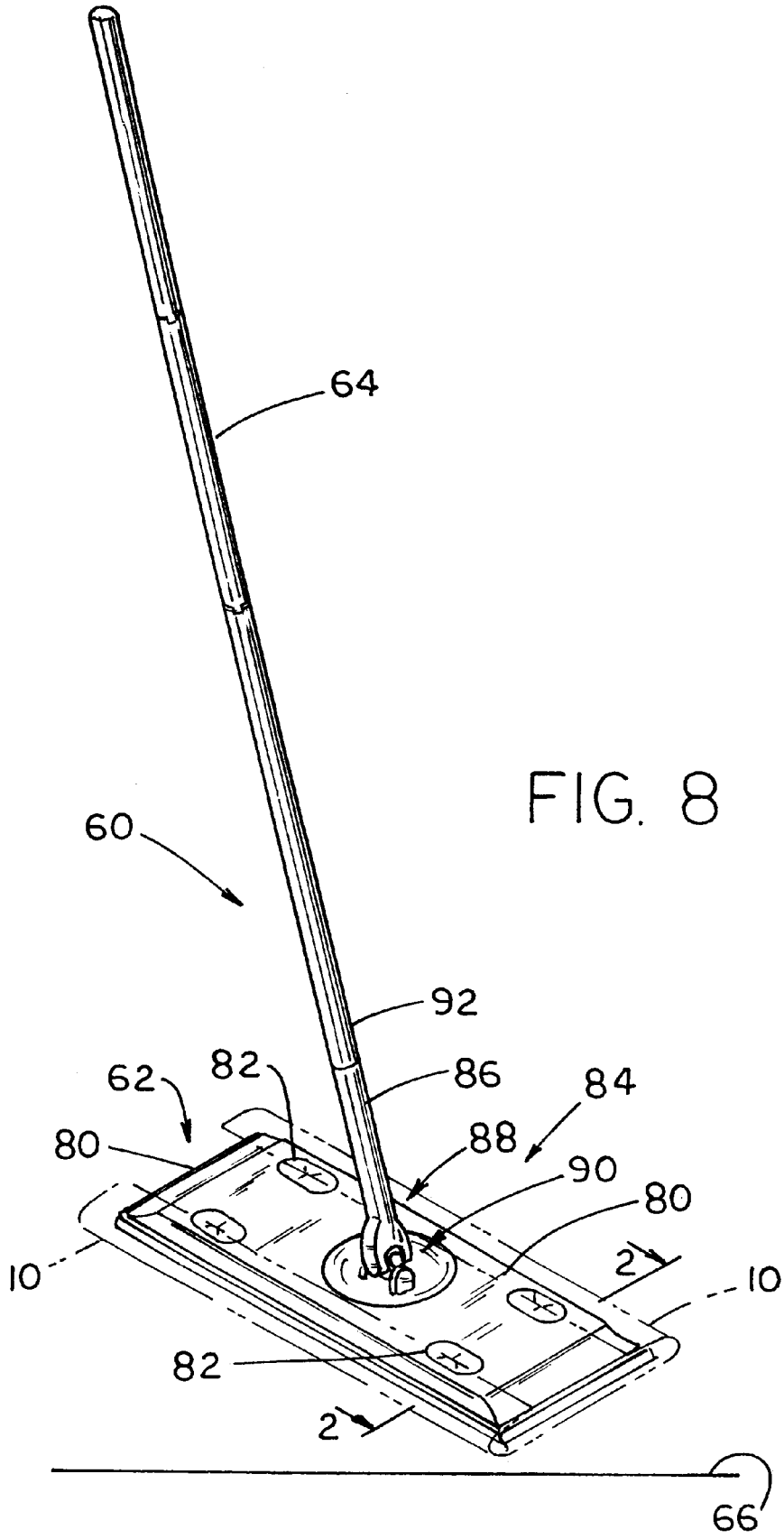
FIG. 8 depicts a dust mop which includes an example of a cleaning sheet removably mounted on a cleaning head.

The cleaning sheet may be used alone (e.g., as a rag) or in combination with another implement(s) to clean a surface. Examples of suitable cleaning implements that can utilize the present cleaning sheet include mops, gloves, dusters, rollers, or wipes. For example, FIG. 8 shows sheet 10 attached to a mounting structure (shown as head 62). Head 62 includes a carriage 80 providing fasteners 82 for mounting pad 10. An elongate rigid member (shown as a segmented handle 64) may be attached to carriage 80 by a mounting structure 84. Mounting structure 84 includes a yoke (shown as an arm 86) having a y-shaped end 88 pivotally mounted to a socket (shown as a ball joint 90). An adapter (shown as a connector 92) threadably attaches arm 86 to handle 64. According to alternative embodiments, the cleaning utensil may be a broom, brush, polisher, handle or the like adapted to secure the cleaning sheet.

Referring to FIG. 8, the cleaning sheet (shown as a dusting pad 10) is depicted attached to a head 62 of a cleaning utensil (shown as a dust mop 60), according to an exemplary embodiment. Pad 10 typically includes a backing layer secured to nonwoven fiber aggregate layer with a plurality of tacky bottomed cavities for attracting and retaining particulate matter. Debris can be drawn into the cavities in the outer cleaning surface and/or become entrapped between the fibers of the nonwoven aggregate layer when pad 10 is moved along a surface to be cleaned (shown as a work surface 66 in FIG. 8). Cleaning sheet 10 is generally somewhat flexible to permit surfaces with different contours (e.g., smooth, irregular, creviced, etc.) to be cleaned. According to an alternative embodiment, the cleaning sheet may be semi-rigid, e.g., where it is designed to be utilized for cleaning planar surfaces.

The cleaning sheet may be attached to the cleaning utensil by any of a variety of fasteners (e.g., friction clips, screws, adhesives, retaining fingers, etc.) as are known to one of skill that reviews this disclosure. According to other alternative embodiments, the cleaning sheet may be attached as a single unit, or as a plurality of sheets (e.g., strips or "hairs" of a mop).

According to another embodiment, the components of the cleaning utensil, namely the mounting structure, adapter and handle may be provided individually or in combinations as a kit or package. The components of the cleaning utensil may be readily, easily and quickly assembled and disassembled in the field (e.g., work site, home, office, etc.) for compactablity and quick replacement. The components of the cleaning utensil may also be provided in a pre-assembled and/or unitary condition. In one particularly suitable embodiment, the cleaning sheet is configured for use with the Pledge™ Grab-It™ sweeper commercially available from S.C. Johnson & Son, Inc. of Racine, Wisconsin.

To clean surface 66, pad 10 is secured to head 62 of mop 60. Pad 10 is brought into contact with surface 66 and moved along this surface (e.g., in a horizontal direction, vertical direction, rotating motion, linear motion, etc.). Debris from surface 66 is entrained within the cavities in the outer fabric layer. Finer particulate material can become entrapped in pores between the fibers of the fabric or bond to the adhesive-coated surfaces within the cavities in the fabric layer. After use, pad 10 may be removed from mop 60 for disposal or cleaning (e.g., washing, shaking, removing debris, etc.). According to an alternative embodiment, the cleaning sheet may be used alone (e.g., hand held) to clean the surface.

Test Methods (1) Breaking Strength (Cross Machine Direction)

From each of the sheets, samples having a width of 30 mm were cut out in the direction perpendicular to the fiber orientation in the sheet, i.e., in the cross machine direction. The sample was chucked with a chuck-to-chuck distance of 100 mm in a tensile testing machine and elongated at a rate of 300 mm/min in the direction perpendicular to the fiber orientation. The value of load at which the sheet began to break (the first peak value of the continuous curve obtained by the stress/strain measurement) was taken as the breaking strength.

(2) Elongation at a Load of 500 g/30 mm

The elongation of the sample, at a load of 500 g in the measurement of the breaking strength in the cross machine direction described above, was measured. For the purposes of this application, "elongation" is defined as the relative increase in length (in %) of a 30 mm strip of cleaning sheet material when a tensile load of 500 g is applied to the strip.

(3) Entanglement Coefficient

The network sheet is removed from the nonwoven fiber aggregate. Where the network sheet has a lattice-like net structure, this is typically accomplished by cutting the fibers which make up the network sheet at their junctures and carefully removing the fragments of the network sheet from the nonwoven fiber aggregate with a tweezers. A sample having a width of 15 mm is cut out in the direction perpendicular to the fiber orientation in the sheet (i.e., in the cross machine direction). The sample is chucked with a chuck-to-chuck distance of 50 mm in a tensile testing machine, and elongated at a rate of 30 mm/min in the direction perpendicular to the fiber orientation (in the cross machine direction). The tensile load value F (in grams) with respect to the elongation of the sample is measured. The value, which is obtained by dividing the tensile load value F by the sample width (in meters) and the basis weight of the nonwoven fiber aggregate W (in g/m$^2$), is taken as the stress, S (in meters). A stress-strain curve is obtained by plotting stress ("S") against the elongation ("strain" in %).

$$\text{Stress } S[m]=(F/0.015)/W$$

Figure 6:
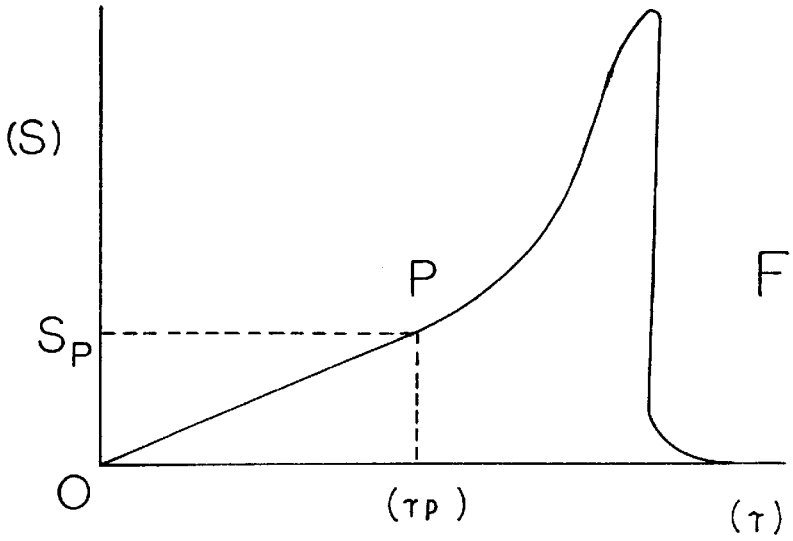
FIG. 6 is a graph showing a stress-strain curve for a typical nonwoven fiber aggregate layer which can be used to form a cleaning sheet.
Figure 7:
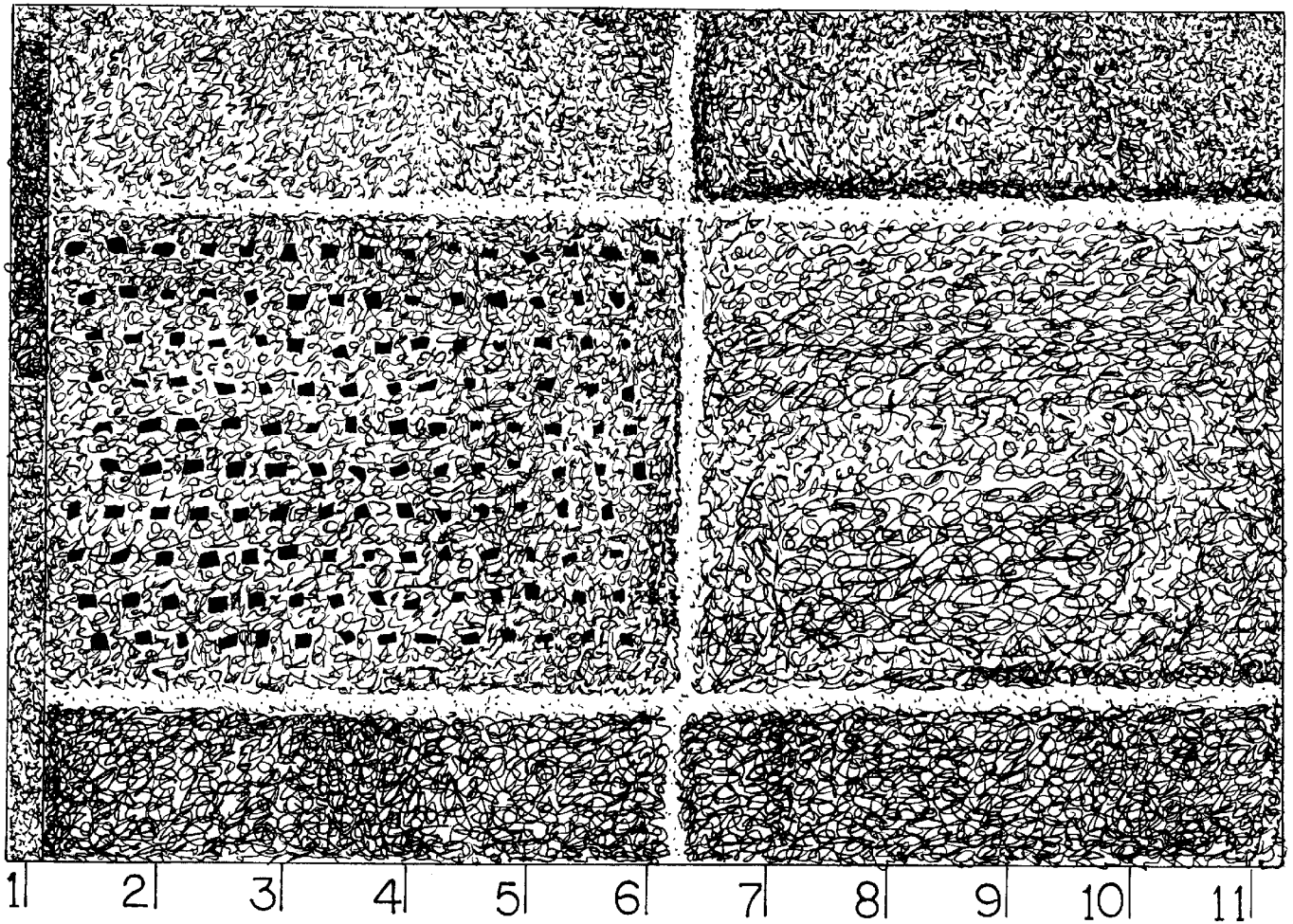
FIG. 7 shows a photograph of an example of a perforated nonwoven aggregate layer used to form the cleaning sheets described in Example 1 herein. The lower half of the photograph shows a corresponding nonwoven aggregate layer without any perforations.

For a nonwoven fiber aggregate, which is held together only through the entanglement of the fibers, a straight-line relationship is generally obtained at the initial stage of the stress-strain (elongation) curve. The gradient of the straight line is calculated as the entanglement coefficient E (in meters). For example, in the illustrative stress-strain curve shown in FIG. 6 (where the vertical axis represents the stress, the horizontal axis represents the strain, and O represents the origin), the limit of straight-line relationship is represented by P, the stress at P is represented by $S_p$, and the strain at P is represented by $\gamma_p$. In such cases, the entanglement coefficient is calculated as $E=S_p/\gamma_p$. For example, when $S_p$=60 m and $\gamma_p$=86%, E is calculated as E=60/0.86=70 m. It should be noted that the line OP is not always strictly straight. In such cases, the line OP is approximated by a straight line.

The articles and methods of the present invention may be illustrated by the following examples, which are intended to illustrate the present invention and to assist in teaching one of ordinary skill how to make and use the invention. These examples are not intended in any way to limit or narrow the scope of the present invention.

EXAMPLE 1

A scrim supported polyester fiber nonwoven cloth was converted into a perforated nonwoven aggregate sheet by cutting holes in the nonwoven aggregate in between the fibers of the supporting scrim. The holes had dimensions between about 2 mm and 5 mm and cross-sectional area of about 4 mm to about 20 $mm^2$. The nonwoven cloth was formed by hydroentangling a polypropylene scrim sandwiched between two carded polyester fiber webs. The polypropylene scrim was a grid of 0.2 mm diameter fibers with a 9 mm spacing between adjacent fibers and had a basis weight 5 $g/m^2$. The two carded polyester webs were formed from 1.5 denier polyethylene terephthalate ("PET") fibers 51 mm in length. Each of the carded polyester webs had a basis weight of 24 $g/m^2$. The combination of the polypropylene scrim and the two carded polyester webs was subjected to water needling ("hydroentanglement") under low energy conditions to produce a unitary nonwoven sheet having a breaking strength of 1500 to 2500 g/30 mm (CD) and an elongation (at 500 g/30 mm) of 4%. After removal of the supporting scrim from the unitary nonwoven sheet, the remaining hydroentangled polyester web had an entanglement coefficient of 65–70 m.

A prototype laminate cloth was constructed from the scrim supported polyester fiber nonwoven cloth described above and a polyester/cotton (65:35) sheet of similar dimensions. The polyester/cotton sheet had a basis weight of about 113 $g/m^2$. The polyester fiber nonwoven cloth had a roughly 5.5"×4.5" (about 140 mm×114 mm) portion which had been perforated with a plurality of holes cut out between the grid of the supporting scrim (as illustrated in FIG. 5). The polyester/cotton cloth was laid flat on a clean surface and sprayed on one side with a light, even layer of a pressure sensitive adhesive (Duro® All Purpose Spray Adhesive; available from Loctite Corp.). The perforated polyester fiber nonwoven cloth was placed onto the adhesive coated side of the polyester/cotton cloth and patted down to ensure complete adhesion of the two sheets. The resulting laminate was allowed to stand at room temperature for at least one hour to permit residual solvent to evaporate from the adhesive. The laminate was then cut to provide a sheet half the size of the cleaning cloths (8"×5.5"; about 200 mm×140 mm) commonly used with a standard Pledge® Grab-It® sweeper. This permitted two test cloths to be mounted side by side on the sweeper during testing.

A second test cloth was prepared by simply laying a sheet of perforated polyester fiber nonwoven cloth onto polyester/cotton cloth which had not been coated with adhesive. Control laminates were constructed from sheets of polyester/cotton cloth and unperforated versions of the scrim supported polyester fiber nonwoven cloth. Control laminates were prepared both with and without an intervening layer of the Duroo All Purpose Spray Adhesive between the cloth layers. In addition to these two control cloths, a commercially available cleaning cloth (Swiffer™ cloth; available from Proctor & Gamble, Cincinnati, Ohio) was included in the dust pick-up/retention tests described below for comparison purposes.

Comparison of Relative Dust Pick-up and Retention

The contents of several used vacuum cleaner bags were separated using sieves to obtain the fraction having particulate matter with a diameter of about 200–500 μm. This fraction was used to conduct the following dust pick-up test. A 10 g portion of the 200–500 μm dust fraction was evenly distributed onto a 6 inch square (about 15.2 cm square) vinyl floor panel. For each experiment, the test cloth was weighed prior to being attached to a standard Pledge® Grab-t™ sweeper. The sweeper was then wiped back and forth over the test floor panel for 30 seconds. After wiping, the sweeper was given a single shake to dislodge any loose particles. The test cloth was then carefully removed and weighed again to determine the weight of dust that had been picked up and retained by the test cloth.

The types cloths used in the dust pick-up/retention tests are listed in Table 1 below. As shown in FIG. 5, the right and left cloths for each test were mounted side by side on a standard Pledge® Grab-It™ sweeper. The inclusion of an adhesive layer in the left hand cloth in Test 1 produced a cloth with an outer fabric surface having a plurality of tacky bottomed cavities (where the adhesive was exposed by the perforations in the outer nonwoven layer).

The results of the test are shown in Table 2 below. The test establishes the enhanced effectiveness of cloths with tacky bottomed cavities for cleaning dirty surfaces. The cleaning cloth with tacky bottomed cavities in its outer cleaning surface (Test 1 Left cloth) exhibited twice the dust capacity of the corresponding cavitied cloth without adhesive (Test 2 Left cloth) and roughly five times the dust capacity of either an unperforated control lacking adhesive (Test 2 Right cloth) or a commercial cleaning cloth (Swiffer™ cloth; available from Proctor & Gamble, Cincinnati, Ohio). The cloth with tacky bottomed cavities was also considerably more effective at dust pick-up/retention in comparison to an unperforated adhesive containing laminate, even though a small amount of adhesive had apparently leaked though onto the cleaning surface of the unperforated analogue (Test 1 Right cloth).

TABLE 1

Test Cloths for Dust Pick-Up Test

| Test # | Left Cloth | Right Cloth |
|---|---|---|
| 1 | Cavitied laminate w/ adhesive | Control laminate w/ adhesive* |

TABLE 1-continued

| Test Cloths for Dust Pick-Up Test | | |
|---|---|---|
| Test # | Left Cloth | Right Cloth |
| 2 | Cavitied laminate w/o adhesive | Control laminate w/o adhesive |
| 3 | Swiffer ™ cloth | Swiffer ™ cloth |

*a small amount of adhesive appeared to have leaked through to the outer fabric surface of the test cloth

TABLE 2

| Dust Pick-Up by Test Cloths | | |
|---|---|---|
| Test # | Left Cloth Dust (g) | Right Cloth Dust (g) |
| 1 | 0.94 | 0.35 |
| 2 | 0.47 | 0.20 |
| 3 | 0.16 | 0.18 |

EXAMPLE 2

Polyester fiber web having a basis weight of 10 g/m$^2$ can be prepared by a conventional carding machine from polyester fiber 51 mm in length and 1.5 denier in diameter. The fiber web is lapped in 3 layers (30 g/m$^2$) and layers of the lapped fiber web are overlaid on the upper and lower sides, respectively, of a biaxially shrinkable polypropylene net (mesh: 5, fiber diameter: 0.215 mm). The resulting combination is subjected to a water needling process to entangle the fiber webs and the net. The water pressure used in the water needling process is about 35–40 kg/cm$^2$ at a nozzle pitch of 1.6 mm while the combination of fiber web and polypropylene net is moved past the nozzles at a line speed of 5 m/min. The hydroentangled combination is then subjected to heat treatment with hot air (130° C.) for about 1–2 minutes to simultaneously dry the web and shrink the polypropylene net. This produces a reinforced nonwoven aggregate having an area shrinkage coefficient of 10% in which depressions and projections are formed over the major surfaces. If desired, 5 wt. % (based on the weight of the fiber aggregate) of a dust adhesion agent (viscosity: 125 cps, surface tension: 30 dyn/cm) consisting of 95% of liquid paraffin and 5% of nonionic surfactant (polyoxethylene (average mol number: 3.3) ($C_{12}$–$C_{13}$) alkyl ether) can be applied to the reinforced nonwoven aggregate to enhance its dust collecting capabilities. A plurality of holes are then cut out of the nonwoven material in the areas between the filaments of the net, e.g., with a punch or a sharp knife, to form a perforated nonwoven aggregate which can be used as a fabric layer in producing cleaning sheets according to the present invention.

While the making and using of various embodiments are discussed in some detail herein, it should be appreciated that the present invention provides inventive concepts which can be embodied in a wide variety of specific contexts. The specific embodiments discussed herein are merely illustrative of specific ways to make and use cleaning sheets and are not meant to limit the scope of the invention. Various modifications and combinations of the illustrative embodiments, as well as other embodiments of the invention, will be apparent to persons skilled in the art upon reference to the description.

The cleaning sheet of the present invention can be manufactured using commercially available techniques, equipment and material. In addition, the cloth may be used on a variety of surfaces such as plastic, wood, carpet, fabric, glass and the like.

Cleaning implements and methods of cleaning surfaces using the cleaning sheet are also provided herein. The cleaning implement may be produced as an intact implement or in the form of a cleaning utensil kit. Intact implements include gloves, dusters and rollers. Kits according to the present invention, which are designed to be used for cleaning surfaces, commonly include a cleaning head and a cleaning sheet capable of being coupled to the cleaning head. In addition, the kit can include a yoke capable of installation on the cleaning head and an elongate handle for attachment to the yoke. Whether provided as a completely assembled cleaning implement or as a kit, the cleaning implement preferably includes a cleaning head which allows the cleaning sheet to be removably attached to the cleaning head.

What is claimed is:

1. A cleaning sheet comprising:

a nonwoven fiber aggregate layer secured to a flexible backing layer;

adhesive disposed between the nonwoven fiber aggregate layer and the flexible backing layer;

wherein the nonwoven fiber aggregate layer has a plurality of apertures therethrough, a basis weight of 30 to 100 g/m$^2$ and a CD initial modulus of 20 to 800 m; and wherein the apertures expose at least a portion of the adhesive.

2. The cleaning sheet of claim 1, having a breaking strength of at least 500 g/30 mm and an elongation at a load of 500 g/30 mm of no more than 25%.

3. The cleaning sheet of claim 1 wherein the fabric layer is secured to the flexible backing layer by the intervening adhesive layer.

4. The cleaning sheet of claim 3, wherein said apertures in said nonwoven fiber layer expose a portion of the adhesive, thereby forming cavities including a tacky bottom surface.

5. The cleaning sheet of claim 4 wherein the tacky bottom surface includes a pressure sensitive adhesive.

6. The cleaning sheet of claim 1 wherein the apertures encompass 5% to 25% of the fiber surface.

7. The cleaning sheet of claim 1 wherein the apertures have a cross-sectional area of at least 1 mm$^2$.

8. The cleaning sheet of claim 1 wherein the apertures have an average cross-sectional dimension of 1 mm to 10 mm.

9. The cleaning sheet of claim 1 wherein said cleaning sheet has a particle retention capacity of at least about 20 g/m$^2$.

10. The cleaning sheet of claim 1 wherein the nonwoven fiber aggregate layer further comprises a dust adhesion agent.

11. The cleaning sheet of claim 10 wherein the dust adhesion agent includes lubricant, surfactant or a mixture thereof.

12. The cleaning sheet of claim 1 wherein the nonwoven fiber aggregate layer includes a network sheet.

13. The cleaning sheet of claim 1 wherein the network sheet is a fiber net or a perforated film.

14. A cleaning sheet comprising:

a nonwoven fiber aggregate layer secured to a flexible backing layer;

wherein the cleaning sheet has a breaking strength of at least 500 g/30 mm and an elongation at a load of 500 g/30 mm of no more than 25%; and the nonwoven fiber aggregate layer has a plurality of apertures therethrough, a basis weight of 30 to 100 g/m$^2$ and a CD initial modulus of 20 to 800 m; the apertures having an average cross-sectional dimension of 1 mm to 10 mm.

15. A cleaning implement comprising:

a cleaning sheet which comprises a nonwoven fabric layer having a basis weight of from 30 to 100 g/m$^2$ and a CD initial modulus of 20 to 800 m; said fabric layer being secured to a flexible backing layer by an adhesive disposed between said fabric layer and the flexible backing layer, and said fabric layer having a plurality of apertures therethrough,;

wherein the apertures expose at least a portion of said adhesive, thereby forming an outer fabric surface with a plurality of cavities therein which include a tacky surface.

16. The cleaning implement of claim 15, further comprising a cleaning head; wherein the cleaning sheet is removably attached to the cleaning head.

17. The cleaning implement of claim 15 wherein said implement is selected from the group consisting of mops, gloves, dusters, rollers, and wipes.

18. A cleaning utensil kit for cleaning surfaces comprising:

a cleaning head;

a cleaning sheet capable of being coupled to the cleaning head, the cleaning sheet comprising a nonwoven fiber aggregate layer secured to a flexible backing layer; wherein the cleaning sheet has a breaking strength of at least 500 g/30 mm and an elongation at a load of 500 g/30 mm of no more than 25%; and the nonwoven fiber aggregate layer has a plurality of apertures therethrough, a basis weight of 30 to 100 g/m$^2$ and a CD initial modulus of 20 to 800 m, wherein the apertures have an average cross-sectional dimension of 1 mm to 10 mm.

* * * * *